US007526844B2

(12) United States Patent
Pearce

(10) Patent No.: US 7,526,844 B2
(45) Date of Patent: May 5, 2009

(54) REPRESENTATIVE STORAGE DEVICE FOR A DECEASED ANIMAL

(76) Inventor: Jeffrey Pearce, 6 Irving St., Valley Stream, NY (US) 11580

( * ) Notice: Subject to any disclaimer, the term of this patent is extended or adjusted under 35 U.S.C. 154(b) by 0 days.

(21) Appl. No.: 11/828,318

(22) Filed: Jul. 25, 2007

(65) Prior Publication Data

US 2009/0025194 A1 Jan. 29, 2009

(51) Int. Cl.
*A61G 17/00* (2006.01)

(52) U.S. Cl. ..... 27/1

(58) Field of Classification Search ..... 27/1; D99/5; 446/73, 369
See application file for complete search history.

(56) References Cited

U.S. PATENT DOCUMENTS 232,782 A 9/1880 Townsend
5,016,330 A 5/1991 Botsch
5,896,632 A 4/1999 Sturino
D418,271 S 12/1999 Parker
6,023,822 A 2/2000 Luebke
6,775,886 B2 8/2004 Ogle, II
6,785,938 B1 * 9/2004 Johansen, Jr. ..... 27/1
7,308,741 B1 * 12/2007 Rydberg et al. ..... 27/1
2002/0100152 A1 8/2002 Ortega
2002/0168919 A1 * 11/2002 Perkins ..... 446/369
2006/0059669 A1 * 3/2006 Rose ..... 27/1

* cited by examiner

*Primary Examiner*—William L. Miller
(74) *Attorney, Agent, or Firm*—Collard & Roe, P.C.

(57) ABSTRACT

A container for housing an urn. The container comprises a body section and a representative covering which is disposed over the body section. There is an opening in the body section wherein there is a cavity disposed in the body section. This cavity is for receiving an urn. Alternatively, there can be a body wherein the cavity that is lined with a lining for housing the cremated remains of an animal. The device can also further comprise a door for covering the opening, and wherein the opening can be selectively opened or closed to insert or remove the remains of the animal. Other embodiments for an opening can include a zipper, or a draw string type opening.

6 Claims, 4 Drawing Sheets

REPRESENTATIVE STORAGE DEVICE FOR A DECEASED ANIMAL

BACKGROUND OF THE INVENTION

The invention relates to a container for housing the remains of an animal. For example, the following prior art is known, U.S. Pat No. 6,023,822 to Luebke; U.S. Patent Application Publication No. 2002/0100152 to Ortega; U.S. Pat. No. 6,775,886 to Ogle, II; U.S. Pat. No. 5,896,632 to Sturino; U.S. Pat. No. 5,016,330 to Botsch; U.S. Pat. No. 232,782 to Townsend; U.S. Pat. No. D 418,271 to Parker the disclosures of these references are hereby incorporated herein by reference.

The above art does not disclose a container for housing an urn having an easily removable cover to be removed from a housing part to allow for easy change of external appearance.

SUMMARY OF THE INVENTION

A container for housing an urn. The container comprises a body section and a representative covering which is disposed over the body section. There is an opening in the body section wherein there is a cavity disposed in the body section. This cavity is for receiving an urn. Alternatively, there can be a body wherein the cavity that is lined with a lining for housing the cremated remains of an animal. The device can also further comprise a door for covering the opening, and wherein the opening can be selectively opened or closed to insert or remove the remains of the animal. Other embodiments for an opening can include a zipper, or a draw string type opening.

There can also be a representative covering that is in the form of a fabric covering forming the shape of an animal. This fabric covering is removable so that it can be selectively washed by an individual.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
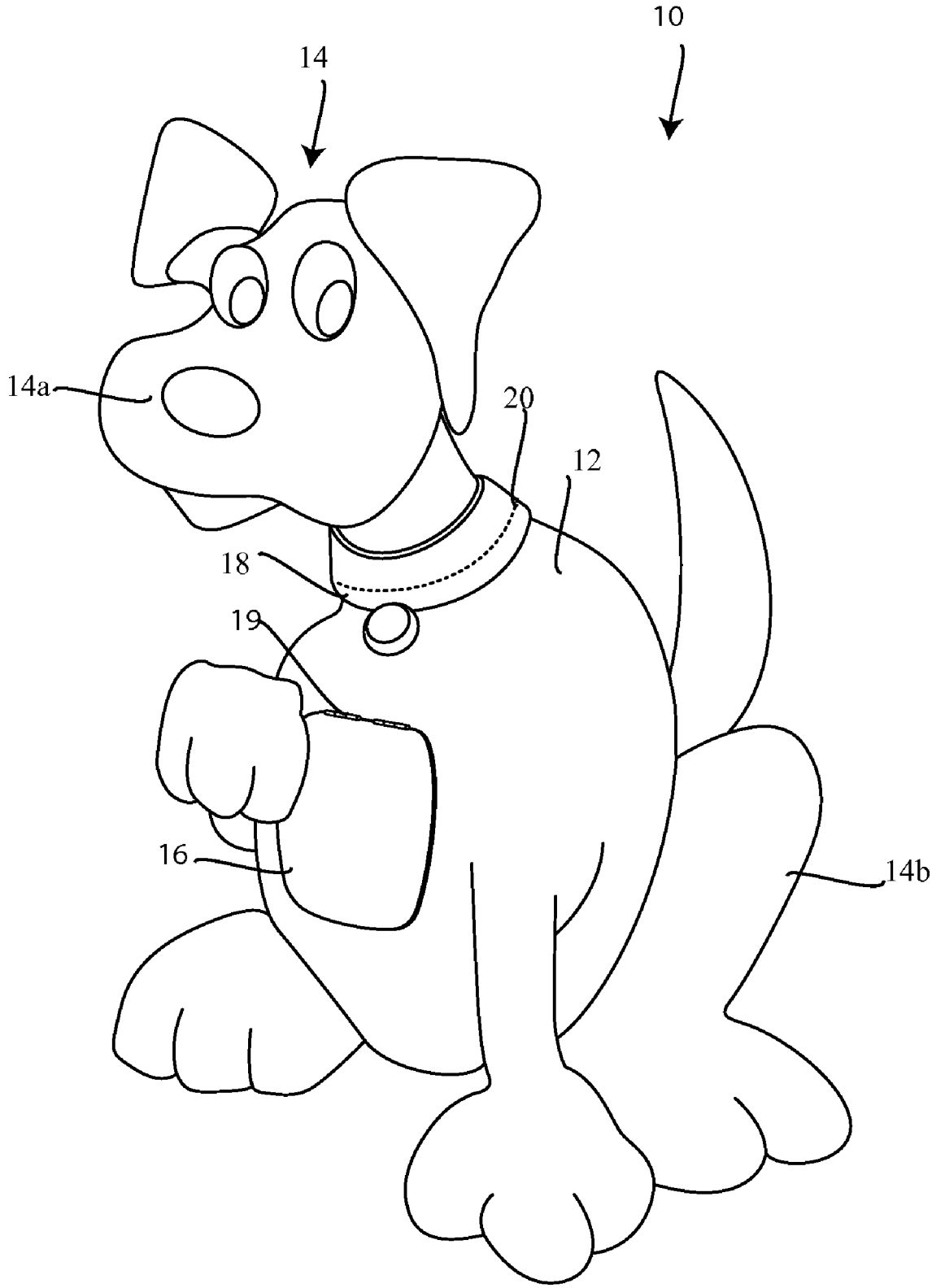
FIG. 1 is a front perspective view of a first embodiment of the invention.

Referring in detail to the drawings, FIG. 1 discloses a perspective view of a first embodiment of the device 10. In this view, there is a body section or housing 12 shown which includes a representative cover 14. There is also a collar or covering 18 which is used to cover a connection element 20 which can be used to connect to different sections of a representative cover 14 together. For example, representative cover 14 can include a first section 14*a* which is a head section and a second section 14*b* which is a body section.

In this case, connection element 20 can be any form of connector such as a hook and loop fastener, a zipper, a series of clasps, buttons, or laces tied together, or a tie string. The representative cover can be slipped over any generic body section and then be used to form a representation of a pet or any other type of animal that a user would like to represent. There is also one opening which can be formed both in the cover and in the body section. This opening can be in the form of a door 16 having a hinge which can be used to open into a cavity section 24 shown in greater detail in FIG. 2.

Figure 2:
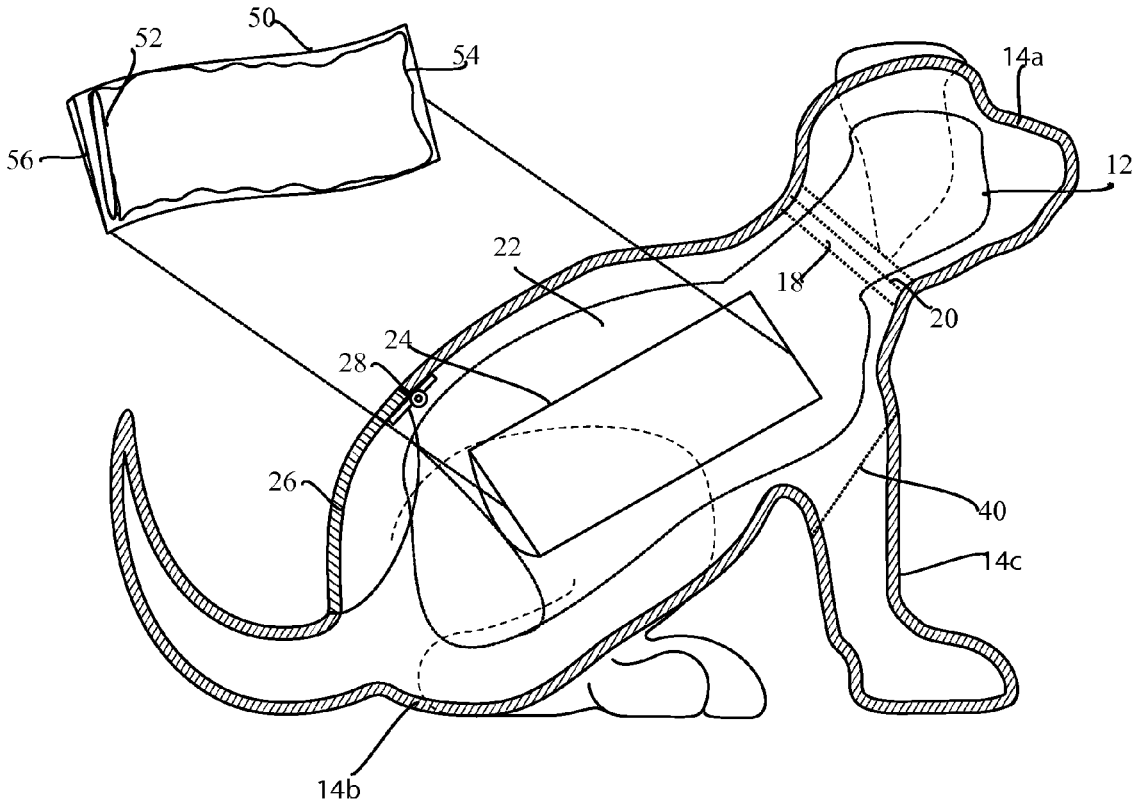
FIG. 2 is a side cross-sectional view of a second embodiment of the invention.

FIG. 2 discloses a cross-sectional view of the device of another embodiment of the device shown in FIG. 1. In this view, representative cover 14 is shown as covering body section 12. This representative cover is shown as in two parts 14*a* and 14*b*. In addition, there is also shown collar 18 which covers connection element 20 as well. This connection element 20 is used to connect both parts of representative cover 14*a* and 14*b* together. Disposed inside of body section 12 is cavity 24 which is surrounded by body filler 22. Body filler 22 can be in the form of any known body filler, such as any type of fabric or other packing material, or it can simply be it an extension of a solid body part 12. Cavity 24 can include an inner lining 50 which can be disposed in cavity 24 and be used to seal any additional remains of a cremated animal inside. For example, there can be a first lining 50 which can be made from rubber to provide a seal between the body section 12 and the cremated remains. This first lining can have a sealable or closable opening 56. In addition there is also a plastic bag type element 54 which can be in the form of a zip-lock® type bag which can be closed via a closure 52, and be used to seal-in the remains of an animal. In this embodiment, there is an opening which is disposed at the rear of the animal which is formed by a door 26. This door 26 is coupled to the rear of the body section 12 via a hinge 28. There is also an optional third part 14*c* to representative cover 14 wherein this third part can also be connected via a second connection element 40.

Figure 3:
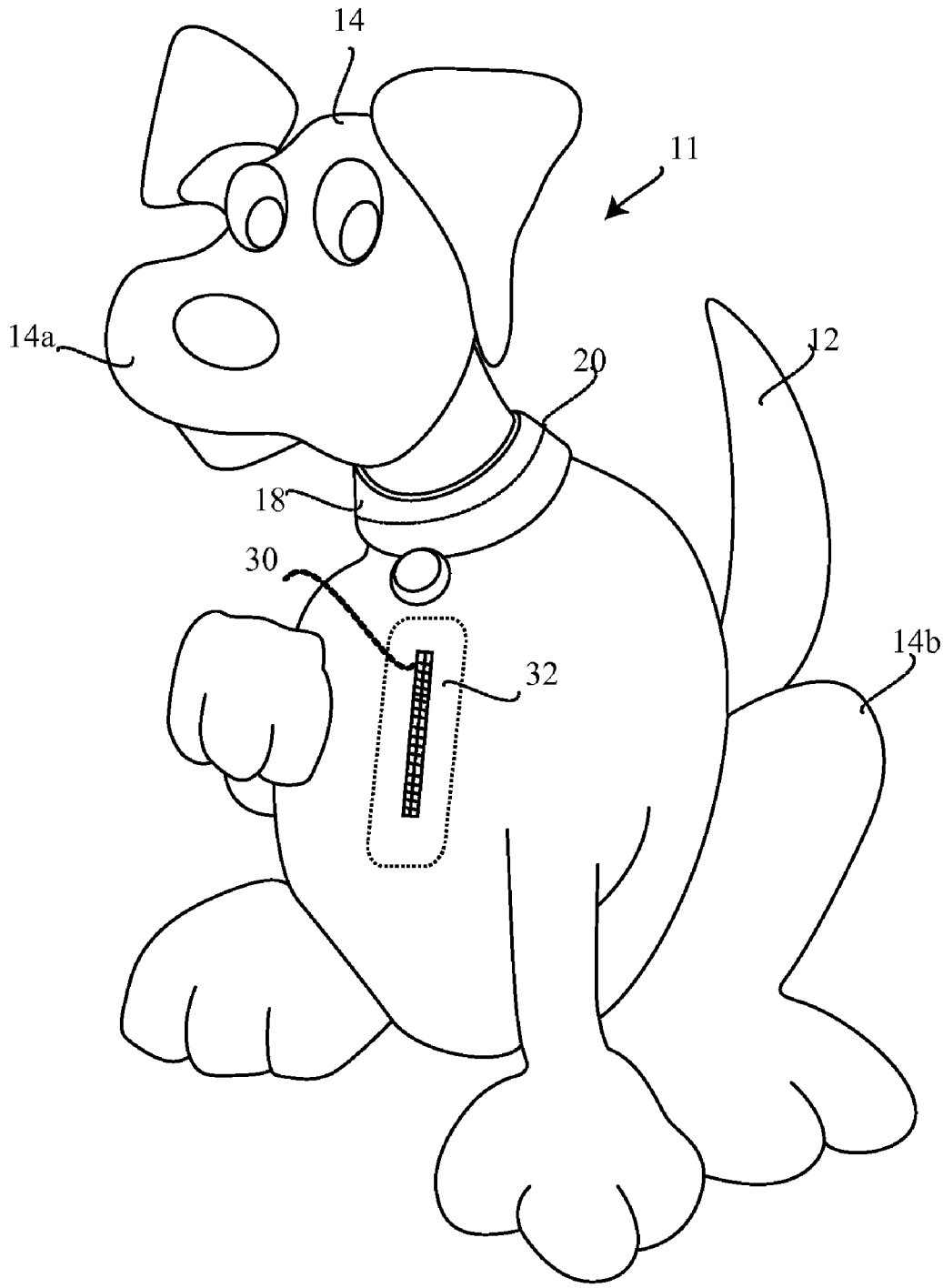
FIG. 3 is a front perspective view of another embodiment of the invention.
Figure 4:
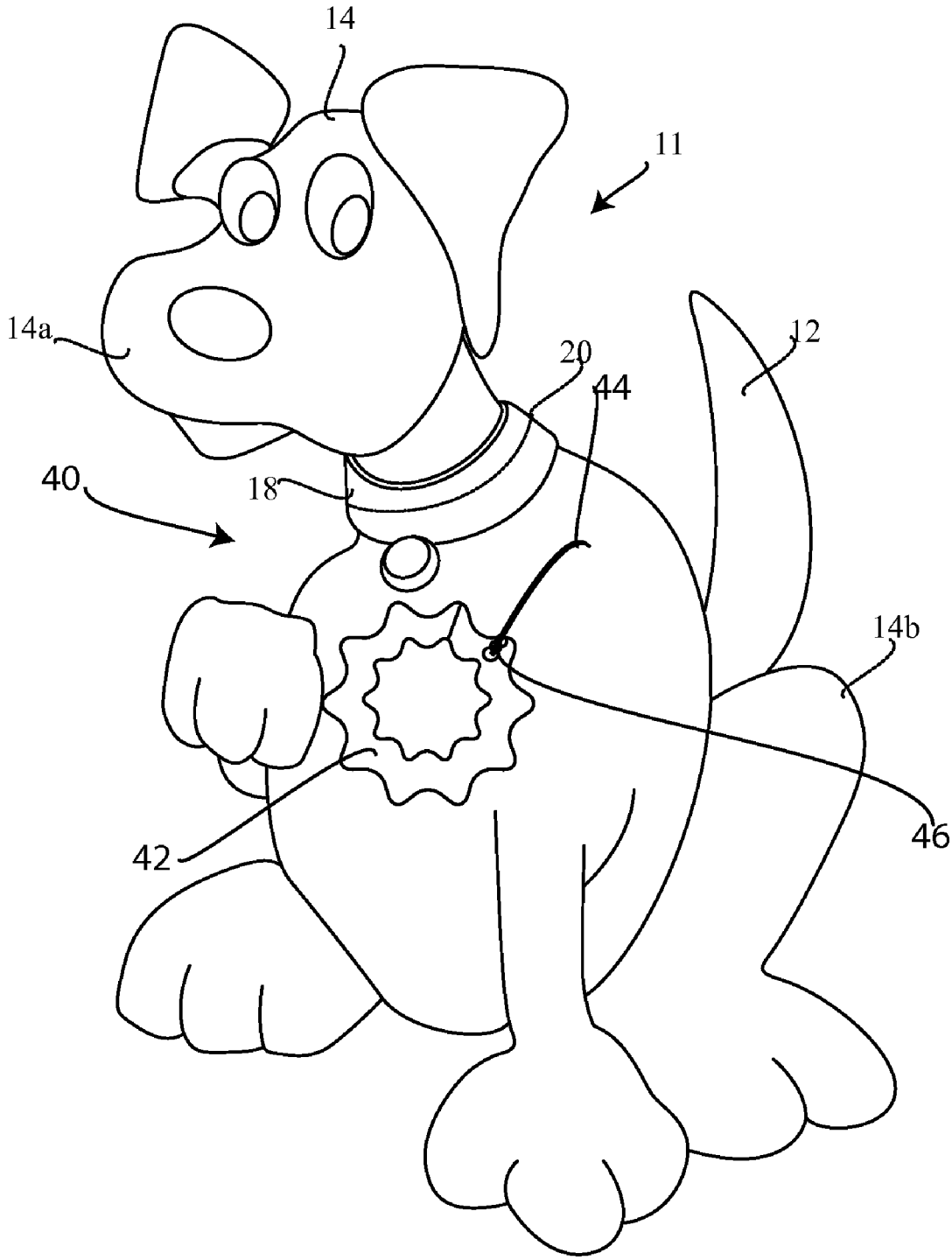
FIG. 4 is a front perspective view of another embodiment of the invention.

FIG. 3 discloses a front perspective view of a second embodiment of the invention. In this view, instead of door 16, there is a zipper opening 30, wherein this zipper opening 30 can be covered by an optional flap 32 to conceal this zipper opening. Alternatively, as shown in FIG. 4, there can be a drawstring opening 40 including a closable perimeter 42 and a drawstring 44 which can include a tie or lock element 46. This lock 46 can be used to keep the drawstring element in a closed position. This drawstring opening can be used to selectively open or close a hole in the font end of the body section to allow the remains of an animal which may be contained in turn to be inserted inside of the body section.

With these designs it is possible to selectively insert the remains of an animal inside of a body section covered by a representative element. In addition, it is also possible to create a generic body for this element for this body section, and then cover it easily with a cover wherein the covering can be comprised of two different parts and then be coupled together via a connector. Thus, the end result is a device which can be used to signify the features of the animal whose remains are disposed inside.

Accordingly, while a few embodiments of the present invention have been shown and described, it is to be understood that many changes and modifications may be made thereunto without departing from the spirit and scope of the invention as defined in the appended claims.

What is claimed is:

1. A cremated remains container for housing an urn storing cremated remains, said cremated remains container comprising:

a) a body section;

b) a representative covering which is disposed over said body section wherein said representative covering is in the form of at least two parts;

c) an opening in said body section wherein said opening is in the form of a door having a hinge;

d) a cavity disposed in said body section, and receiving therein said urn storing cremated remains;

e) a rubber lining having a sealable opening therein, said rubber lining disposed within said cavity and receiving and sealing said urn directly therein via said sealable opening, said rubber lining for separating said urn from said cavity;

f) at least one connector for connecting said at least two parts of said representative covering.

2. The container as in claim 1, wherein said representative covering is in the form of a fabric covering forming the shape of an animal.

3. The container as in claim 2, wherein said fabric covering is removable.

4. The container as in claim 1, wherein said body section is made from a resilient plastic.

5. The container as in claim 1, wherein said body section is made from fabric.

6. The container as in claim 1, wherein said urn is a sealable plastic bag.

* * * * *